US007482518B1

(12) United States Patent
DiSanto

(10) Patent No.: US 7,482,518 B1
(45) Date of Patent: Jan. 27, 2009

(54) HIGH DENSITY SOUND ENHANCING COMPONENTS FOR STRINGED MUSICAL INSTRUMENTS

(75) Inventor: Robert DiSanto, Naples, FL (US)

(73) Assignee: Stone Tone Music, Inc., Naples, FL (US)

( * ) Notice: Subject to any disclaimer, the term of this patent is extended or adjusted under 35 U.S.C. 154(b) by 553 days.

(21) Appl. No.: 11/247,135

(22) Filed: Oct. 12, 2005

Related U.S. Application Data

(60) Provisional application No. 60/617,095, filed on Oct. 12, 2004.

(51) Int. Cl.
*G10D 3/00* (2006.01)

(52) U.S. Cl. ..... 84/291

(58) Field of Classification Search ..... 84/290, 84/291, 267
See application file for complete search history.

(56) References Cited

U.S. PATENT DOCUMENTS 3,769,871 A * 11/1973 Cawthorn ..... 84/291

6,415,584 B1 * 7/2002 Whittall et al. ..... 84/312 R

* cited by examiner

*Primary Examiner*—Kimberly R Lockett
(74) *Attorney, Agent, or Firm*—The Livingston Firm; Edward M. Livingston

(57) ABSTRACT

The present invention provides a system for producing vibratical unification of components of a musical instrument comprised of a soundboard, a plurality of strings, a bridge system, a neck, and a body. The system acoustically interconnects the major sound components of the musical instrument in a time-correct sound transfer loop. An acoustically high sound conductivity material selected from the group comprising minerals, ceramics, metals, and combinations thereof, is employed as an interconnect member to produce a balanced, compressed, and naturally equalized sound, with extreme clarity and sustain, and with minimal distortion. The low end sound that is produced by the unified components are coherent, tight, and well defined. The acoustically high sound conductivity material has a specific gravity on the order of at least 2, and preferably at least the specific gravity on the order of the specific gravity of granite. Advantageously, the specific gravity is at least four, and can be six or higher.

19 Claims, 6 Drawing Sheets

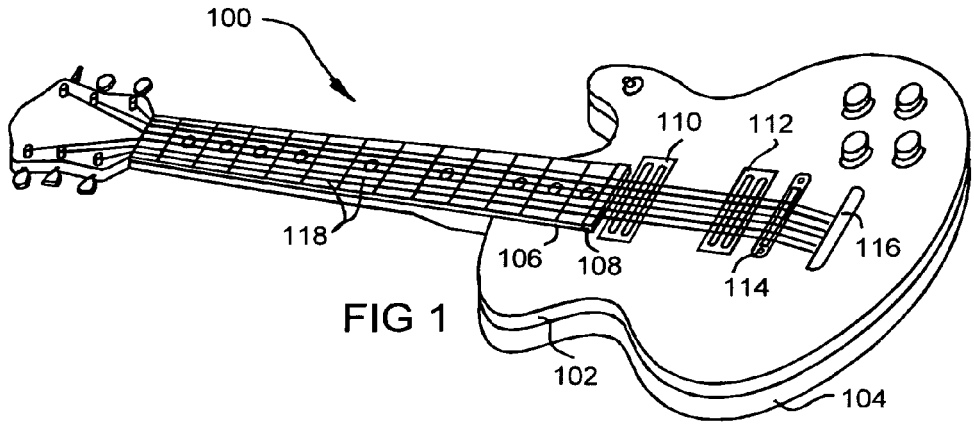
FIG 1
FIG 2
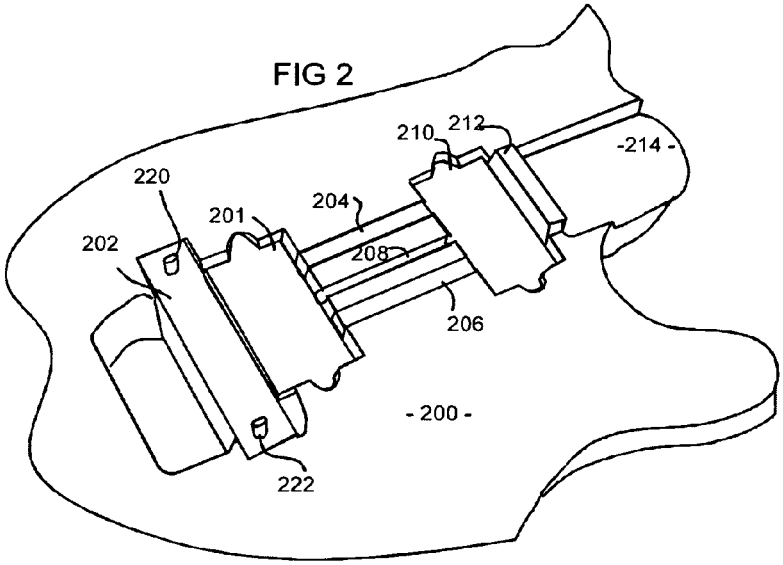

FIG. 5
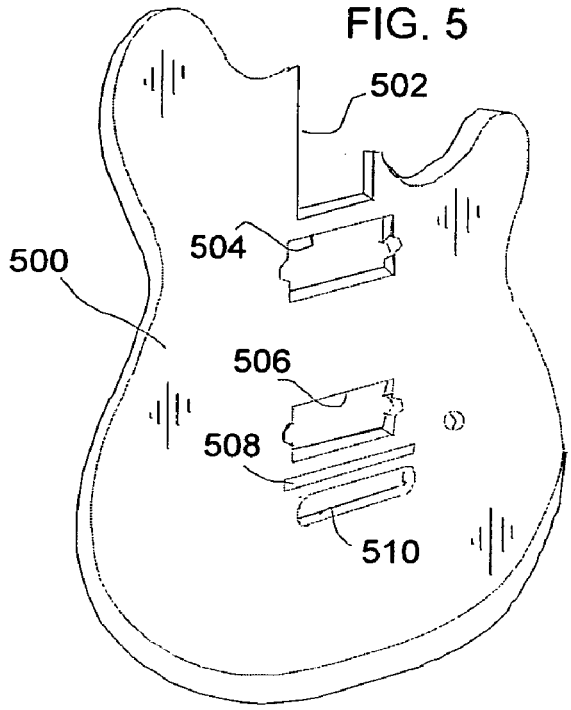
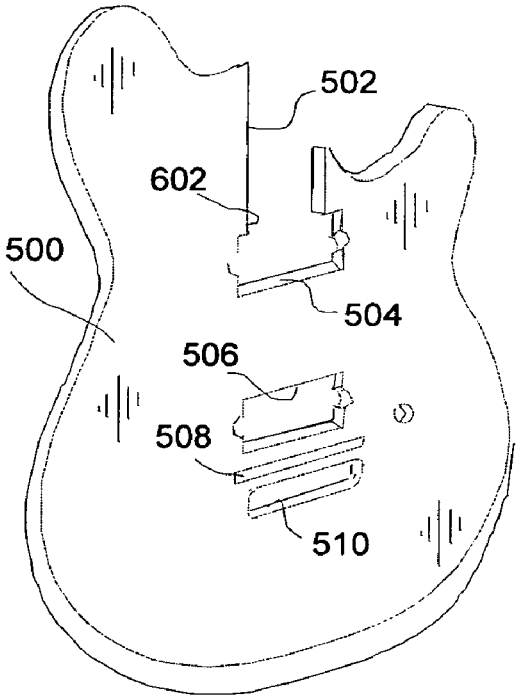
FIG. 6

HIGH DENSITY SOUND ENHANCING COMPONENTS FOR STRINGED MUSICAL INSTRUMENTS

CROSS-REFERENCE TO RELATED APPLICATIONS

This application is a continuation-in-part of U.S. application Ser. No. 10/903,159, entitled "AUDIO DEVICE HAVING DENSE SOUND ENHANCING COMPONENT", filed Jul. 30, 2004 which application claims the benefit of provisional patent application 60/491,058, for an Audio Device Having Dense Shell, filed Jul. 30, 2003; and claims the benefit of provisional patent application 60/617,095, filed Oct. 12, 2004, entitled, "High Density Soundboard for stringed Musical Instruments", and provisional patent application 60/702,992, filed Jul. 28, 2005, and entitled "High Density Sound Enhancement Device For Stringed Musical Instrument". The entire disclosure and contents of the above applications are hereby incorporated by reference, as though recited in full.

GOVERNMENT INTEREST STATEMENT

NONE

BACKGROUND

1. Field of the Invention

The invention relates to a stringed musical instrument having a soundboard and/or other enhancements made of a dense material, in particular, granite, and more particularly, to a music generating device including acoustic instruments and electrically amplified musical instruments, with further particularity, the invention relates to a high density veneer and/or other stone enhancements for a string instrument such as a guitar, bass, banjo, viola, cello. Dobro™ and lapsteel guitar, and the like.

2. Related Art

It is well recognized that wood, in particular aged wood, makes an ideal material for such musical instruments such as a piano, violin, guitar, or the like. U.S. Pat. No. 3,769,871 to Cawthorn for a "Stone Guitar With A Tuned Neck", issued in 1973. The patent discloses a heavy stone slab, typically 1 to 1.125 inches thick for use in guitars. According to the patent, the flat stone body is of a mineral or petrified matter such as granite, marble, onyx, rose quartz, petrified wood, or agate. It can have a hollowed out cavity for the electric pickups. It is a solid body guitar except for the cavity for the electrifying of the guitar. It is further disclosed that the cavity can be covered with a conventional pick guard.

U.S. Pat. No. 5,267,499 to Othon, discloses a method of enhancing and modifying the visual and aural characteristics of a stringed instrument wherein the flat surfaces of a stone and the body of a stringed instrument are adhesively secured together. The stone is worked while the stone is bonded to the instrument to reduce the thickness of the stone and produce a stone laminate. According to the disclosure of the patent, the stone employed may be extremely dense and hard, extremely soft (soapstone being an example), or anywhere in between in order to provide the desired effect. An extremely hard rock, for example, will give the musical instrument great sustain properties. A softer rock or stone, on the other hand, may be used to affect the sound in other ways, such as "softening" the tone and resonance. The patent further discloses that when the stone laminate is positioned at the pick guard of an electric stringed instrument, the aural characteristics are affected due to shielding of the instrument's electronic components.

U.S. Pat. No. 5,097,514 for an Equilateral Tetrahedral Speaker discloses that the enclosure can be constructed of dense material such as a CORIAN™ material to minimize enclosure coloration. CORIAN™ is Dupont's registered trademark for its premium quality brand of solid surface product that is a solid, homogeneous, filled material containing methyl methacrylate.

U.S. Pat. No. 4,190,739 for High-Fidelity Stereo Sound System discloses that in an actual embodiment of a surface, marble gravel was glued across the surface of a parabolic surface like the parabolic surface of well-known microwave antennas.

U.S. Pat. No. 4,805,221 for the Construction of Sound Converter in Sound Guide Especially for Loudspeakers, for Example Speaker Boxes, discloses that the conventional technology for attaining this object consists in providing the sound guide and housing with sufficiently thick walls, adding braces and reinforcements, and/or selecting a material which has high internal clamping. Examples of this are speaker boxes made of concrete, marble, ceramic Plexiglas, and aluminum.

SUMMARY

According to a first broad aspect of the present invention, stone can be used as a resonating surface for an acoustical device, such as a musical instrument. With many such instruments, weight of the instrument is a critical factor. For example, musicians generally reject guitars that weigh over 8 or 9 pounds. Similar weight limitations apply to other string instruments, such as banjos, mandolins, violins, and the like. An instrument such as a piano generally does not have a weight limitation from the standpoint of a performer but practical considerations limit the weight of pianos.

According to another broad aspect of the invention, it has now been found that although a material such as granite would not resonate in a manner comparable to wood, providing a stringed musical instrument with a thin acoustical veneer of stone as a sound board, in conjunction with grounding and interconnecting, and having stone as the major sound-generating components of the instrument, dramatic acoustic benefits can be produced. The added stone enhancements are designed to connect and vibratically unify the soundboard, strings, bridge system, pickups, neck and body in a time-correct sound transfer loop.

According to a further broad aspect of the invention, it has now been found that the added stone enhancements collective mass and high-efficiency transmission rate focuses, retains and centralizes the instruments core vibrations producing a balanced, compressed, naturally equalized sound with remarkable clarity and sustain with minimal distortion. It should be understood, that when reference is made to a veneer, it is not intended to be inclusive of a mere thin, decorative layer, such as typically made from materials such as wood, metal, paper or plastics. The veneer must be of sufficient mass to function as an acoustic material. For an instrument like a guitar, a granite veneer is preferably in the range from about ⅛ to 11/16 of an inch.

According to still another broad aspect of the invention, connecting and vibratically unifying the soundboard, strings, bridge system, pickups, neck and body in a time-correct sound transfer loop, produces a balanced, compressed, and naturally equalized sound, with remarkable clarity and sustain, and with minimal distortion.

In another aspect of the invention, the vibratical unification is produced through the use of high sound conductivity materials to acoustically interconnect the soundboard, strings, bridge system, pickups, neck, and body in a time-correct sound transfer loop. The high sound conductivity material can be a mineral such as stone, in particular granite, ceramics, metals, and other high density solid materials.

The guitars body weight, in combination with the other instrument component, must be no more than nine pounds and preferably no greater than eight pounds. Most preferably, the total weight of a guitar is no greater than eight pounds. Thus, the basic components are maintained at a minimum weight and the dense acoustic veneer provides the additional weight to bring the weight of the instrument to the desired maximum weight.

According to another broad aspect of the invention the weight of the veneer or soundboard, as for example, granite is at least two pounds and preferably, at least three pounds, but no greater than five pounds. While this is preferable for a standard size guitar, other instruments can use either heavier to lighter weights of material.

It should be evident that the mass of the dense acoustic layer is far in excess of that which would be used for mere decorative purposes. Stated another way, the veneer layer has sufficient mass to function as an acoustic resonating material. The dense acoustic veneer does additionally provide the functional advantage of high durability and dramatic aesthetic appeal. In some instances, the veneer can be thinner than noted above, when used in combination with one or more blocks of granite embedded in the body to provide the desired mass and resonance qualities.

According to a further broad aspect of the invention a stringed musical instrument is provided having a body section and a headstock secured to the body section by a neck region. The headstock includes means for securing the distal ends of a plurality of strings to the musical instrument. A bridge supports the proximal ends of said strings above the body section, and anchoring means secures the proximal ends of the strings to the body section of the musical instrument. A stone soundboard is secured to the body section for enhancing the acoustical output of the musical instrument. The soundboard, most advantageously is a layer of granite having a thickness in the range from about ⅛ to about ⅜ of an inch.

In one embodiment of the invention, the body section is a solid piece of wood, having a plurality of recessed areas. In another embodiment of the invention, the stringed musical instrument has a hollow body section, a head stock secured to said body by a neck region (said head stock providing a means for securing the distal ends of a plurality of strings to the head of the musical instrument), a bridge to support the proximal ends of said strings above the soundboard, means for securing the proximal ends of the strings to the body of the musical instrument, and a soundboard secured to said body section, wherein the soundboard is a thin acoustical layer of granite. In both embodiments the instrument includes one or more granite blocks or sound transfer rods which collectively contact and acoustically interconnect the soundboard, body, bridge/tremolo system, pickups, the string anchoring member, and the neck region. The advantages of the present invention are independent of the design of such components as the tremolo and pickups.

In a further embodiment of the present invention, a granite pickup tray acoustically supports an instrument pickup. The granite pickup tray is a granite block generally having a thickness of roughly one eighth of an inch. Most preferably, each of at least two pick-ups is in physical, that is, acoustic contact with transfer rods and each of the transfer rods are in acoustic contact with the soundboard, the underside of the pickup trays, the neck joint, and the bridge block.

In still a further embodiment of the invention, a ceramic or metal pickup tray acoustically supports an instrument pickup. The ceramic or metal pickup tray is a block generally having a thickness less than one eighth of an inch. The size of the ceramic, metal, or granite block is relative to the mass of the block. Accordingly, size of the block is inversely proportional to the density of the block. Most preferably, each of at least two pick-ups is in physical, that is, acoustic contact with transfer rods, and each of the transfer rods are in acoustic contact with the soundboard, the underside of the pickup trays, the neck joint, and the bridge block.

The present invention provides a system for producing vibratical unification of components of a musical instrument comprised of a soundboard, a plurality of strings, a bridge system, a neck and a body. The system acoustically interconnects each of the components in a time-correct sound transfer loop. An acoustically high sound conductivity material selected from the group comprising minerals, ceramics, metals, and combinations thereof, is employed to acoustically interconnect the major sound components of the musical instrument and thus produce a balanced, compressed, and naturally equalized sound, with extreme clarity and sustain, and with minimal distortion. The acoustically high sound conductivity material has a specific gravity on the order of at least 2, and preferably at least the specific gravity on the order of the specific gravity of granite. Advantageously, the specific gravity is at least four, and can be six or higher.

BRIEF DESCRIPTION OF THE DRAWINGS

The invention will be described in conjunction with the accompanying drawings, in which;

FIG. 1 is a perspective view of a stringed musical instrument, specifically, a guitar, in accordance with an embodiment of the present invention;

FIG. 2 is a fragmentary perspective views of a solid body guitar having recesses in accordance with an embodiment of the present invention;

FIG. 5 is a perspective view of a soundboard in accordance with an embodiment of the present invention; and FIG. 6 is a perspective view of a soundboard in accordance with an another embodiment of the present invention.

DETAILED DESCRIPTION

Figure 3:
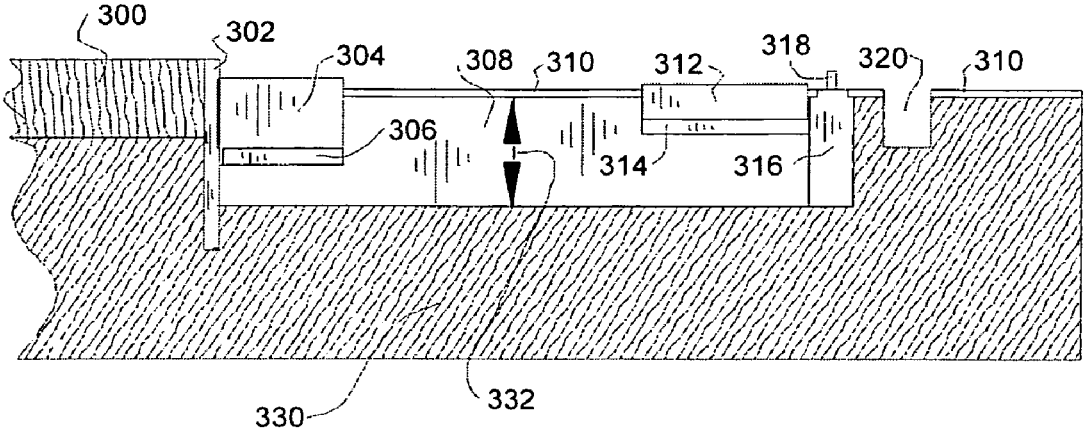
FIG. 3 is a fragmentary cross-sectional side view of a solid body guitar having acoustic enhancement elements, in accordance with an embodiment of the present invention.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, the term "pickup" refers a standard electromagnetic pickup, a pickup such as disclosed in U.S. Pat. No. 6,770,807, to Myers, issued Aug. 3, 2004, any of the patents cited in the Myers patent, the disclosures of which are all incorporated herein by reference, or any design hereinafter invented. The term "instrument pickup" refers to the general class of pickups including, but not limited to piezo pickups and magnet field pickups.

For the purposes of the present invention, the term "acoustic contact" as employed herein, means that two elements are held in firm physical contact, as for example by a non-acoustic insulating or isolating layer of adhesive, or by physical pressure, such that sound vibrations are transmitted from one element to another without significant loss. As taught in the aforenoted co-pending patent application, the gluing operation must be cared out in a manner that assures that the adhesive does not function to clampen sound transmissions from one element to the other.

For the purposes of the present invention, the term "vibratical" as employed herein, means that two elements are joined together such that the vibratory motion a first element is rapidly transferred to a second element, substantially free of loss of vibratory energy and substantially free of vibration alteration. Vibratic transfer is also characterized by vibrational transfer with minimal distortion. The accurate transfer of vibrations from element to element requires firm physical contact, as for example, through the use of a non-acoustic insulating or isolating layer of adhesive, and/or by physical pressure, such that sound vibrations are transmitted from one element to another without significant loss.

For the purposes of the present invention, the term "block studs" refers to a device that connects to the bridge of the instrument.

For the purposes of the present invention, the term "block" is a mass of any solid piece of a hard substance, such as granite, ceramic, metal, and the like. A block can have any shape ranging from an elongated rod like shape, to having one or more flat sides, and is inclusive of spherical and curved masses. A block is used as a support and/or a vibratical element that is characterized by transmitting acoustical vibrations are from one element to another, without significant loss.

For the purposes of the present invention, the term "bridge" is inclusive of the tremolo type as disclosed and described in U.S. Pat. No. 6,118,057, or U.S. Pat. No. 6,143,967 to Smith, et al for a Tremolo for Guitar, the disclosures of which is incorporated by reference herein as though recited in full. Additionally, it can be similar to that of the '057 or '967 patents but without a tremolo mechanism, or other mechanisms, as well known in the art.

For the purposes of the present invention, the term "tremolo" is inclusive of a device that is either incorporated with the bridge or the string anchoring mechanism.

For the purposes of the present invention, the term "hollow or solid bodied stringed musical instrument" can be a member selected from the group comprising an acoustic guitar, an electric guitar, an acoustic bass, an electric bass, a cello, a viola, and similar solid and hollow bodied string instruments.

For the purposes of the present invention, when reference is made to granite, in the following Description, it should be understood the reference is also applicable to other high density materials that are characterized by vibratically unifying the soundboard, strings, bridge system, pickups, neck and body in a time-correct sound transfer loop, and thereby enabling the stringed instrument to produce a balanced, compressed, and naturally equalized sound, with remarkable clarity and sustain, and with minimal distortion. In the category of solid minerals or stones, granite is a preferred material.

For the purposes of the present invention, when reference is made in the following. Description to a guitar, it should be understood the reference is equally applicable other stringed instruments that benefit from the use of high density materials that are characterized by vibratically unifying the sound transmitting components of the instruments, such as the soundboard, strings, bridge system, neck and body in a time-correct sound transfer loop, and thereby enabling the stringed instruments to produce a balanced, compressed, and naturally equalized sound, with remarkable clarity and sustain, and with minimal distortion.

Description

The stringed musical instrument will be described in relationship to a guitar, but the principles are applicable to other musical instruments as previously noted.

The guitar of FIG. 1 is generally indicated by arrow 100. The guitar has a neck stock 106 that is in acoustic contact with the neck joint block 108. An instrument pickup 110 is mounted on, and in acoustic contact with a granite block (i.e.; pickup tray block) that is not visible in the Fig. The same is true for the second instrument pickup 112.

The body of the guitar 100 is shown as solid wood 104 with a granite veneer layer (i.e.; soundboard) 102 acoustically bonded thereto.

A bridge 114 is secured by bridge studs to a granite block (i.e.; bridge block) that is not visible in FIG. 1. The strings 118 are secured to the body of the guitar by an anchoring mechanism 116, as well know in the art, which can be mounted to a granite block (i.e.; string block) that is not shown, or mounted directly to the granite soundboard. Either the bridge 114 or the anchoring mechanism 116 can be of the tremolo type, as well known in the art.

The granite veneer layer 102 functions as a thin soundboard. In the embodiment of a solid body guitar, the body can be thinner than a typical solid body guitar with the difference being about equal to the thickness of the granite layer that is applied to the top surface of the guitar. In this manner, the weight of the wood is reduced and the overall thickness of the body remains the same. The acoustic enhancement that is attained is attributed to the use of the granite soundboard and the other internal or external stone enhancements.

As illustrated in FIG. 2, in addition to the standard solid body configuration in which a recess or neck base 214 is provided for the base of the neck, recesses can be provided for granite blocks or pickup trays 201 and 210. The depth of each recess is set to conform to the dimensions of the instrument pickups and not all instrument pickup recesses need be of the same depth. The granite pickup trays are located under the two instrument pickups that are employed in this embodiment. Obviously, the number of pickups can vary from one to three or even four if desired. Preferably, a thin granite block, generally referred to herein as a pickup tray, is used beneath each pickup, but less than all pickups can be mounted on a pickup tray. Additionally a bridge block 202 is provided under the soundboard to maximize the transfer of the acoustic vibrations to the body of the guitar.

Additionally, a neck joint block 212 can be provided to maximize the acoustic contact between the base of the "neck" and the body 200 of the guitar. Additionally, a granite neck joint block 212 can be in acoustic contact with the base of the neck of the guitar, the body 200 of the guitar, the granite acoustic transfer rods 204 and 206 and the pickup tray 210. Thus, the neck is in enhancing acoustic contact with the soundboard. The combination of sound transmission from the neck joint to the transfer rods, the pickup trays resting on and in acoustic contact with the sound transfer rods, and the bridge and string block having a snug fit or bonding fit to the backside of the soundboard makes all the vibrations work in unison.

Acoustic contact between the various granite blocks is achieved using one or more transfer rods 204 and 206. As illustrated in FIG. 2, two granite transfer bars, 204 and 206 are employed, but fewer or additional transfer rods or bars can be used.

The bars are seen in a perspective view in FIG. 2, and in a side view in FIG. 3. The transfer bars 308 can be about three eighths of an inch thick and sufficiently long to reach from the bridge block 316 to the neck joint block 302. The dimensions are determined by the dimensions of the stringed instrument, and the determination is within the ability of one of ordinary skill in the art. The height of the transfer rods 308 is determined in part by the dimensions of the instruments pickups 304 and 312, and the need to have sufficient mass of the rods set into the body 330 of the guitar. A dimension of about a half of an inch, from the bottom of the tray 306 to the bottom of the transfer rod is generally preferred. Advantageously, the dimension from the bottom of the rod 308 to the bottom surface of the granite soundboard 310 is about one inch. Preferably, the neck joint block 302 extends into the wood solid body about one quarter of an inch in order to have an acoustic integration with the body of the guitar.

Figure 4:
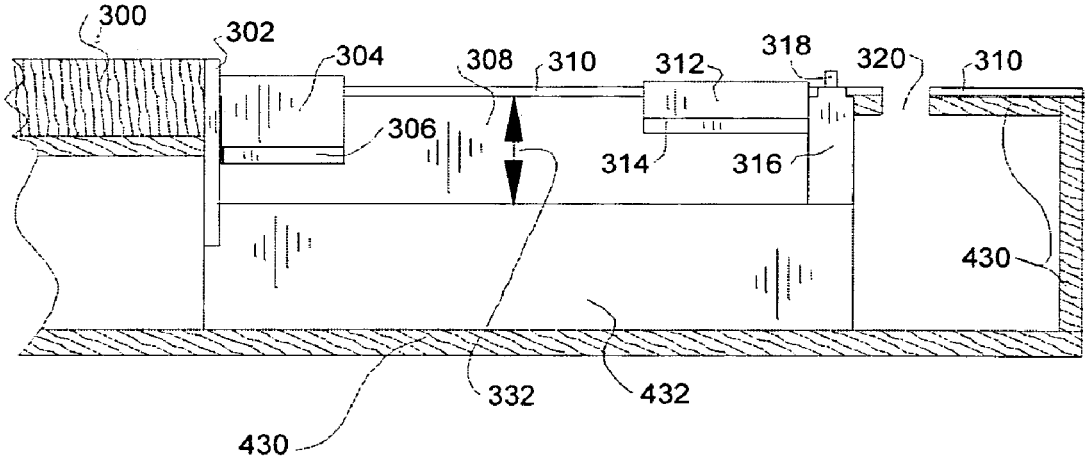
FIG. 4 is a fragmentary cross-sectional side view of a hollow body guitar having acoustic enhancement elements, in accordance with an embodiment of the present invention.

In the embodiment of FIG. 4, the sound transfer rods 308 are supported by a support member 432. The support member 432 can be integrally formed with the transfer rod 308 or can be a separate element, as for example, a wooden support member. The support member 432 is preferably supported on the inner surface of the backside of the hollow wooden body 430.

As illustrated in FIG. 5, the soundboard 500 is provided with a cutaway region 502 for receiving the neck of the guitar, a cutaway region 504 to receive an instrument pickup, a cutaway region 506 to receive another instrument pickup, a cutaway region 508 to receive a bridge block and a cutaway region 510 to receive a string anchoring mechanism.

As illustrated in FIG. 6, the neck cutaway region 502 can extend to the instrument pickup cutaway region 504, in order to prove a region 602 to accommodate the neck block.

It is critical that the bars are in firm contact and the same technique can be used to bond the blocks together as is used to bond the granite soundboard 310 to the body 330. Alternatively, or in addition thereto, a press or wedge fit can be used to wedge the blocks in place and acoustically bond the blocks and transfer rods together. A wedge fit of the neck joint block to the wood of the guitar enhances the vibration transfer from the guitar body to the joint block and subsequently to the soundboard.

Figure 7:
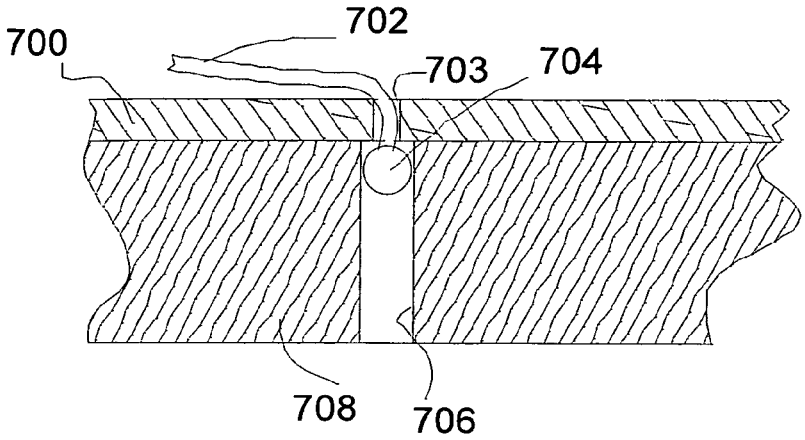
FIG. 7 is a fragmentary cross-sectional side view of a string anchoring region of a guitar in accordance with an embodiment of the invention.

The anchoring of the strings can be through the use of prior art devices that can be anchored to the granite soundboard. In another embodiment of the invention, as illustrated in FIG. 7, the soundboard 700 is provided with a string hole 703 that is smaller in diameter than the ball or ring 704 at the anchoring end of the string 702. Access to the hole is achieved through the hole 706 in the backside of the solid body 708 of the guitar.

Figure 8:
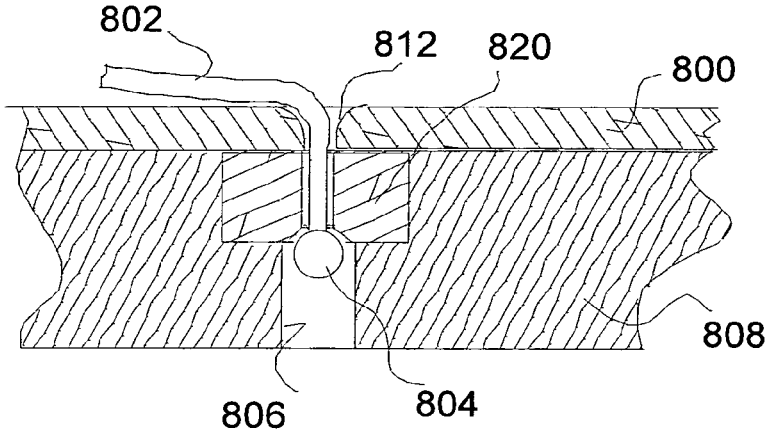
FIG. 8 is a fragmentary cross-sectional side view of an alternative string anchoring region of a guitar in accordance with another embodiment of the invention.

In another embodiment as illustrated in FIG. 8, the string 802 passes through a countersunk hole 812 in the soundboard 800 and is mounted in a granite block (i.e.; string block) 820 that is mount to the underside of the soundboard 800. The string anchor block 820 is provided with a countersunk hole for receiving the string 802 and nesting of the ball, ring, or the like at the end of the string 802. The hole 806 in the body 808 of the guitar provides access to the anchor block 820.

Figure 9:
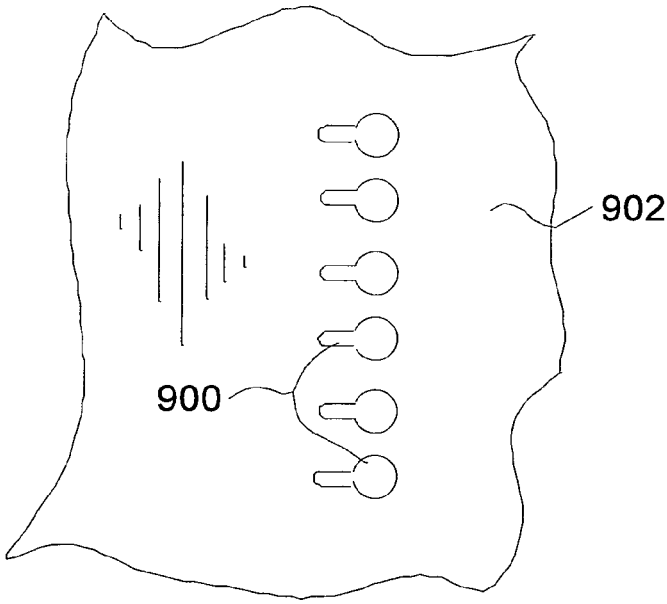
FIG. 9 is a fragmentary top view of the string-anchoring region of a guitar in accordance with an embodiment of the invention.

In a further embodiment as illustrated in FIG. 9, the soundboard 902 is provided with a keyhole slot 900 for each string. The ball, ring, or the like at the end of the string has a diameter less than that of the large opening in the keyhole. A recess in the solid body accommodates the ball, ring, or the like at the end of the string. A hollow body instrument would not have an equivalent recess since the entire body is in essence, a cavity.

The use of granite blocks and a granite soundboard is not only applicable to solid bodied electric guitars, basses and the like, but also to hollow bodied acoustic guitars and the like.

Figure 10:
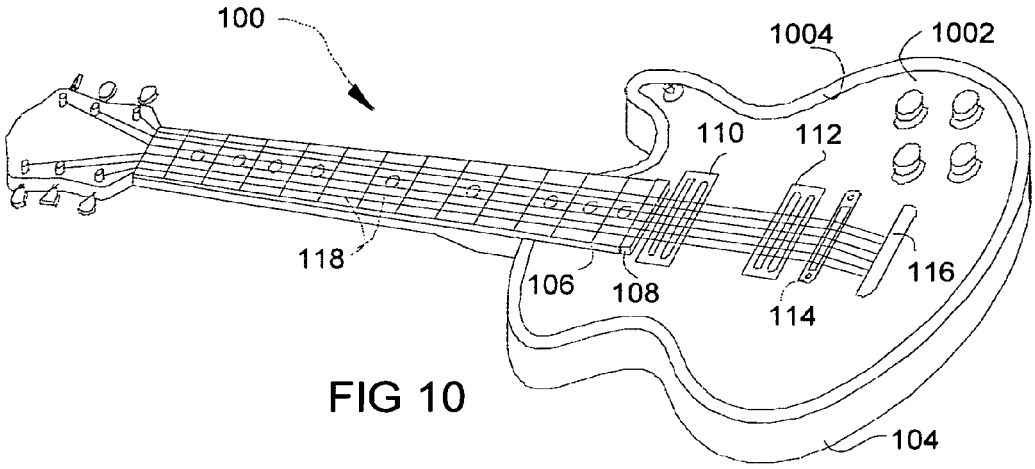
FIG. 10 is a perspective view of a guitar having an insert of high density material set into the wood of the guitar, as in the style of a frame.
Figure 11:
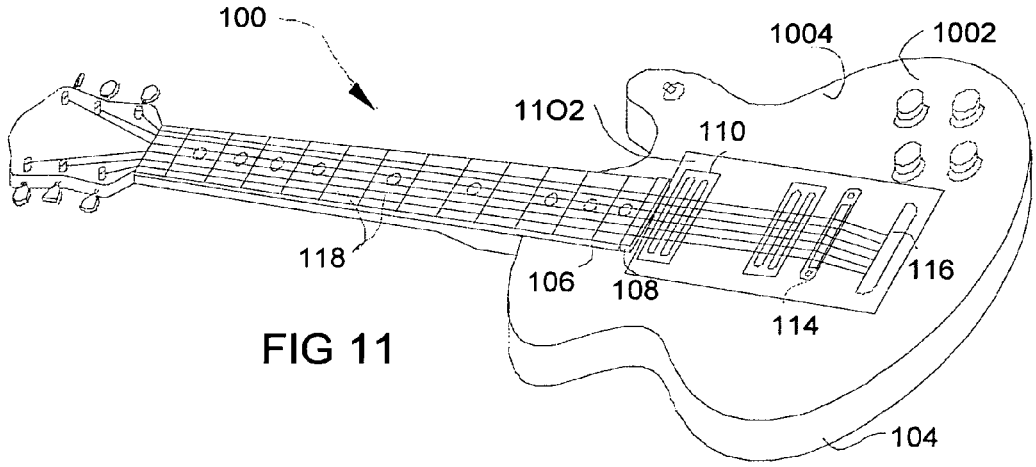
FIG. 11 is a perspective view of a guitar having an insert of high density material set into the wood of the guitar, as in the style of an inlay.

As illustrated in FIG. 10 and FIG. 11, the stone 1002, such as granite, can be inserted into a recess 1004 in the top of the soundboard. This provides the advantage that the otherwise exposed edge of the stone top layer is not seen and do not required being processed to provide a polished edge surface. The manufacturing cost and time is significantly improved by virtue of the elimination of the edge finishing step. The thickness of the sound enhancing insert is as thin as possible from a manufacturing standpoint, while thick enough to provide a mass that is sufficient to contribute to the desired sound enhancing quality of the system. The required thickness must be correlated with the density of the top layer, insert, or inlay. In the example of granite, the thickness is preferably from one eight of an inch to one sixteenth of an inch, and preferably about three thirty seconds of an inch. The preferred weight range for the soundboard is about one half pound to three quarters of a pound. The weight range holds true for all materials, whereas thickness varies in relation to the density of the soundboard material.

In the embodiment of FIG. 11, the insert can be in the form of an inlay 1102 that at least covers the region from the string anchor 116, to the neck block 108 or the neck 106. The inlay can be of any desired shape. The use of an inlay provides a mechanism for reducing the weight of a granite top layer, without having to reduce the thickness of the granite.

Figure 12:
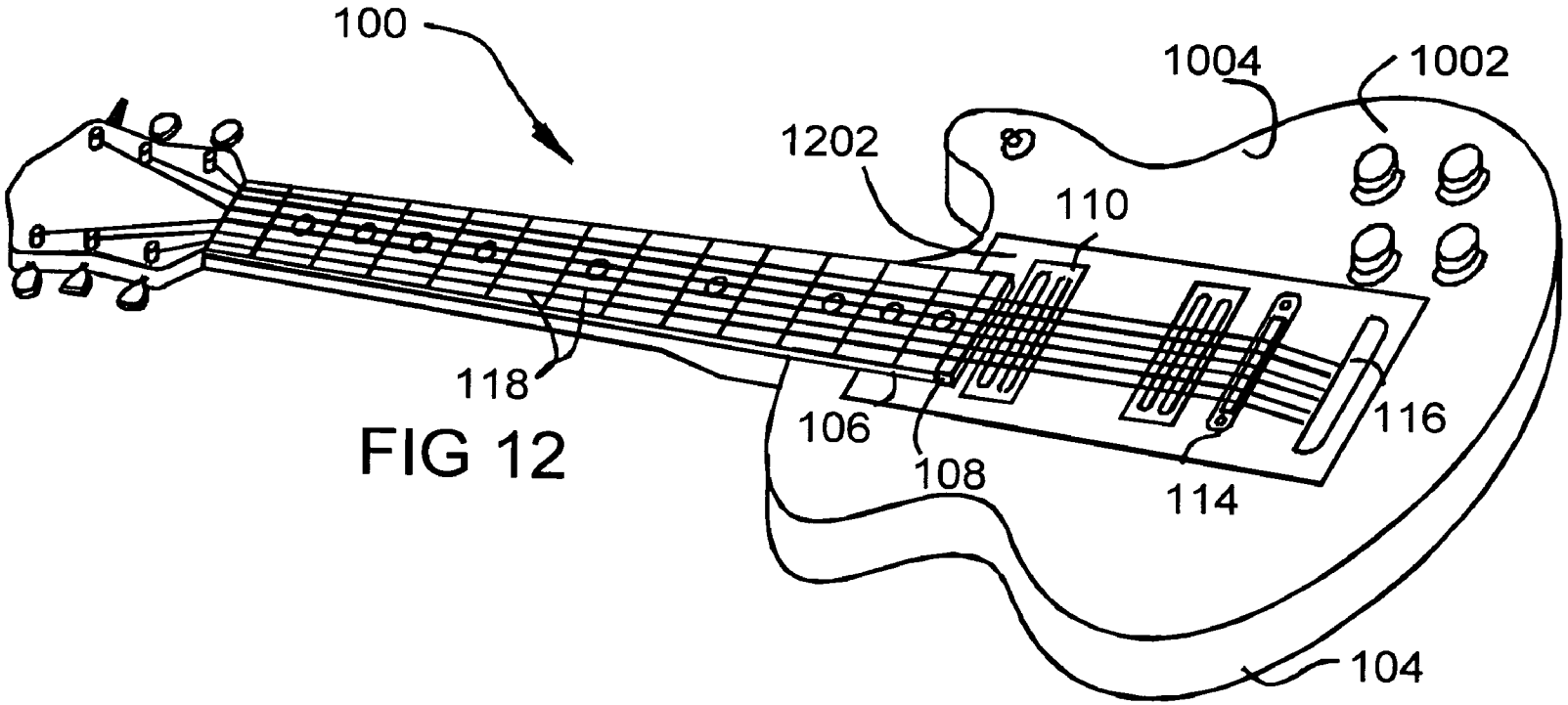
FIG. 12 is a perspective view of a guitar having an insert of high density material set into the wood of the guitar, as in the style of an inlay that extends from the neck of the guitar to the string anchor.

Similarly, in the embodiment of FIG. 12, the inlay 1202 can extend further into the neck region 106, than the embodiment illustrated in FIG. 11. A single inlay or multiple inlay can employed, though the use of a single inlay is preferred.

It should be understood that other components as well known in the art can be used, as for example a tremolo, or other devices now known or that may come into use in the future. Granite grounding blocks linked together by transfer rods, such as 106, can be used with one or more of such other devices.

The granite blocks preferably weigh between 5 and 10 ounces and have dimensions in the range from ⅛ inch thick for the block that supports an acoustic pick up, ¼ inch thick for a block that supports a bridge, weight of 8 ozs for each of two transfer rods, and 2 oz each and ½ oz for the neck joint block. The weights and dimensions set forth herein are preferred for the average solid body guitar and can be varied based on the requirements of specific stringed instruments. Variations or adjustments can also be made to provide a range of acoustic enhancements, as needed.

Preferably, the bridge block is in direct acoustic contact with the transfer rods and the pickup trays are in direct acoustic contact with the neck joint and the soundboard. Contact between the various granite blocks and the soundboard can be achieved through the use of a granite acoustic transmission or sound transfer rod. Specifically, the granite transfer rod is in acoustic contact with the soundboard and a plurality of granite blocks. Preferably, each granite block that is in acoustic contact with an electric pickup component is in acoustic contact with the soundboard via a sound transfer rod. The stone, in particular granite, that is used for the pickup tray should be substantially free of metals that can interfere with electromagnetic pickups or produce an electric ground. Black Absolute granite from India is substantially free of the zinc and copper that can be found in granite. Black Galaxy granite is preferred for the bridge block, neck joint block, and transfer rods.

Granites, like most natural materials, vary in their properties. The following tables illustrate comparative densities of solid minerals, ceramics, and metals. The tables illustrate that a metal such as Tungsten has a density that is roughly 30 times that of a typical wood, such as teak, ceramics can have a density that is roughly 20 times that of a wood such as Teak, and granites have a density that is roughly 4 times that of a wood such as Teak.

It should be recognized that there is a range of densities for woods, minerals, ceramics, and metals. Advantageously, the high sound conductivity material has specific gravity of at least 2. Preferably, the high sound conductivity material has a specific gravity of at least 4, and more preferably, at least 6. The selection of a high density material should be consistent, that is, at least equal to the ability of granite to enhance the sounds produced at the lower end. The sounds produced by the deeper notes tend to be garbled to an extent that is difficult or impossible to clean up electronically. The dense material, such as granite, produces sound that is coherent, tight, and well defined.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

TABLES

Density/Specific Gravity

| Mineral | Kg/cu · cm |
|---|---|
| Basalt, solid | 3011 |
| Dolomite, solid | 2899 |
| Glass, window | 2579 |
| Granite, solid | 2691 |
| Marble, solid | 2563 |
| Soapstone talc | 2400 |

| Wood - seasoned & dry | Kg/cu · m |
|---|---|
| Afromosia | 705 |
| Apple | 660-830 |
| Ash, black | 540 |
| Ash, white | 670 |
| Aspen | 420 |
| Balsa | 170 |
| Bamboo | 300-400 |
| Birch (British) | 670 |

TABLES-continued

Density/Specific Gravity

| | |
|---|---|
| Cedar, red | 380 |
| Cypress | 510 |
| Douglas Fir | 530 |
| Ebony | 960-1120 |
| Elm (English) | 600 |
| Elm (Wych) | 690 |
| Elm (Rock) | 815 |
| Iroko | 655 |
| Larch | 590 |
| Lignum Vitae | 1280-1370 |
| Mahogany (Honduras) | 545 |
| Mahogany (African) | 495-850 |
| Maple | 755 |
| Oak | 590-930 |
| Pine (Oregon) | 530 |
| Pine (Canadian) | 350-560 |
| Pine (Red) | 370-660 |
| Redwood (American) | 450 |
| Redwood (European) | 510 |
| Spruce ( Canadian) | 450 |
| Sycamore | 590 |
| Teak | 630-720 |
| Willow | 420 |

| Metal or alloy | kg/cu · m |
|---|---|
| aluminium - melted | 2560-2640 |
| aluminium bronze (3-10% Al) | 7700-8700 |
| beryllium copper | 8100-8250 |
| brass - casting | 8400-8700 |
| brass - rolled and drawn | 8430-8730 |
| bronze - lead | 7700-8700 |
| bronze - phosphorous | 8780-8920 |
| bronze (8-14% Sn) | 7400-8900 |
| cast iron | 6800-7800 |
| gold | 19320 |
| iron | 7850 |
| lead | 11340 |
| silver | 10490 |
| steel - rolled | 7850 |
| steel - stainless | 7480-8000 |
| tin | 7280 |
| titanium | 4500 |
| tungsten | 19600 |
| white metal | 7100 |
| zinc | 7135 |
| Aluminium has a sp g of 2.5. Its density is 2.5 × 62.4 = 156 lbs/cu.ft. | |

[Sorted by Material Category]
[Sorted by Density]

| Densities sorted by Material Category | | Specific gravity | |
|---|---|---|---|
| Ceramic | Alumina | 3.9 | |
| Ceramic | BeO | 2.85 | |
| Ceramic | Boron Carbide | 2.5 | |
| Ceramic | Borosilicate Glass | 2.3 | |
| Ceramic | Hafnium Carbide | 12.76 | |
| Ceramic | Silicon Nitride | 3.28 | |
| Ceramic | Silicon carbide | 3.2 | |
| Ceramic | Sintered SiC | 3.1 | |
| Ceramic | TiC | 4.94 | |
| Ceramic | Tungsten Carbide | 15.7 | 15,700 kg/cu · m |
| Ceramic | Vanadium Carbide | 5.71 | |
| Ceramic | Zirconium Carbide | 6.56 | |
| Composite | Carbon-Carbon Composite | 1.65 | |
| Liquid | Water, 4° C. | 0.99997 | |
| Metal | Aluminum | 2.643 | 2,643 kg/cu · m |
| Metal | Aluminum bronze | 7.702 | 7,702 kg/cubic meter |
| Metal | Aluminum, 2024-T3 | 2.77 | |
| Metal | Aluminum, 6061-T6 | 2.7 | |
| Metal | Aluminum, 7079-T6 | 2.74 | |
| Metal | Beryllium | 1.8477 | |
| Metal | Brass | 8.553 | 8,553 kg/cu · m |

TABLES-continued

Density/Specific Gravity

| | | | |
|---|---|---|---|
| Metal | Bronze, aluminum | 7.702 | |
| Metal | Bronze, phosphor | 8.8 | |
| Metal | Bronze, ~11% Tin | 8.1 | |
| Metal | Carbon Steel | 7.84 | |
| Metal | Carbon Tool Steel | 7.82 | |
| Metal | Cobalt | 8.8 | |
| Metal | Copper, Pure | 8.9 | |
| Metal | Copper, cast-rolled | 8.906 | |
| Metal | German Silver | 8.586 | |
| Metal | Gold Coin (US) | 17.19 | |
| Metal | Gold, Pure | 19.32 | |
| Metal | Gold, cast-hammered | 19.3 | |
| Metal | High Speed Tool Steel | 8.75 | |
| Metal | Iron, Cast, Pig | 7.207 | |
| Metal | Iron, Ferrosilicon | 6.984 | |
| Metal | Lead | 11.37 | |
| Metal | Manganese | 7.608 | |
| Metal | Molybdenum, wrought | 10.3 | |
| Metal | Monel Metal, rolled | 8.688 | |
| Metal | Nickel | 8.602 | |
| Metal | Pure Iron | 7.86 | |
| Metal | Silver, Pure | 10.5 | |
| Metal | Soft Steel (0.06% C) | 7.87 | |
| Metal | Stainless 27Cr | 7.47 | |
| Metal | Stainless Steel, 304 | 8.03 | |
| Metal | Tantalum | 16.6 | |
| Metal | Thorium, Ind. melted | 11.6 | |
| Metal | Tin, cast-hammered | 7.352 | |
| Metal | Titanium | 4.5 | |
| Metal | Tungsten | 18.82 | 18,820 kg/cu · m |
| Metal | Wrought Iron | 7.75 | |
| Metal | Zinc, Cast | 7.049 | |
| Metal | Zirconium | 6.3798 | |
| Plastic | HDPE | 0.955 | |
| Plastic | Kevlar 149 | 1.47 | |
| Wood | Birch | 0.705 | |
| Wood | Cherry | 0.433 | |
| Wood | Mahogony | 0.705 | |
| Wood | Red Oak | 0.673 | |
| Wood | Southern Pine | 0.65 | |
| Wood | Sugar Maple | 0.689 | |
| Wood | Walnut | 0.593 | |

Densities sorted by Material Density

| Category | Material | Density (g/cc) | |
|---|---|---|---|
| Wood | Cherry | 0.433 | |
| Wood | Walnut | 0.593 | |
| Wood | Southern Pine | 0.65 | |
| Wood | Red Oak | 0.673 | |
| Wood | Sugar Maple | 0.689 | |
| Wood | Birch | 0.705 | |
| Wood | Mahogony | 0.705 | 705 kg/cu · m |
| Plastic | HDPE | 0.955 | |
| Liquid | Water, 4° C. | 0.99997 | |
| Plastic | Polyurethane | 1 | |
| Ceramic | Graphite | 2.163 | |
| Ceramic | Quartz Glass | 2.2 | |
| Ceramic | Borosilicate Glass | 2.3 | |
| Ceramic | Boron Carbide | 2.5 | |
| Ceramic | Aluminosilicate | 2.6 | |
| Ceramic | Glass | 2.6 | |
| Metal | Aluminum | 2.643 | |
| Metal | Aluminum, 2024-T3 | 2.77 | |
| Ceramic | Lead Glass | 2.8 | |
| Ceramic | Mullite | 2.82 | |
| Ceramic | BeO | 2.85 | |
| Ceramic | RB-SiC | 3.09 | |
| Ceramic | Sintered SiC | 3.1 | |
| Ceramic | Silicon Nitride | 3.28 | |
| Ceramic | Alumina, 85% | 3.41 | |
| Ceramic | Alumina, 99.9% | 3.96 | |
| Metal | Titanium | 4.5 | |
| Ceramic | TiC | 4.94 | |

TABLES-continued

Density/Specific Gravity

| | | |
|---|---|---|
| Ceramic | Vanadium Carbide | 5.71 |
| Ceramic | Mg-PSZ | 5.75 |
| Ceramic | PSZ | 5.75 |
| Ceramic | Zirconia | 5.75 |
| Metal | Zirconium | 6.3798 |
| Ceramic | Zirconium Carbide | 6.56 |
| Metal | Iron, Ferrosilicon | 6.984 |
| Metal | Zinc, Cast | 7.049 |
| Metal | Iron, grey cast | 7.079 |
| Metal | Tin, cast-hammered | 7.352 |
| Metal | Stainless 27Cr | 7.47 |
| Metal | Manganese | 7.608 |
| Metal | Iron, wrought | 7.658 |
| Metal | Aluminum bronze | 7.702 |
| Metal | Steel, tool | 7.715 |
| Metal | Pure Iron | 7.86 |
| Metal | Soft Steel (0.06% C) | 7.87 |
| Metal | Stainless 18Cr-8Ni | 8.03 |
| Metal | Stainless Steel, 304 | 8.03 |
| Metal | Brass | 8.553 |
| Metal | German Silver | 8.586 |
| Metal | Nickel | 8.602 |
| Metal | Monel Metal, rolled | 8.688 |
| Metal | High Speed Tool Steel | 8.75 |
| Metal | Bronze, phosphor | 8.8 |
| Metal | Copper, Pure | 8.9 |
| Metal | Nickel, Pure | 8.9 |
| Metal | Copper, cast-rolled | 8.906 |
| Metal | Molybdenum, wrought | 10.3 |
| Metal | Silver, Pure | 10.5 |
| Metal | Lead | 11.37 |
| Ceramic | Hafnium Carbide | 12.76 |
| Ceramic | Tungsten Carbide | 15.7 |
| Ceramic | WC/Tungsten Carbide | 15.7 |
| Metal | Tantalum | 16.6 |
| Metal | Tungsten | 18.82 |

Note:
kg/cu · m divided by 16.02 = lbs/cu.ft = 2500 KG/cu · m

| COMPARISON | | kg/cu · m |
|---|---|---|
| Wood | Teak | 630-720 |
| Mineral | Granite, solid | 2,691 ~4X |
| Ceramic | Tungsten Carbide | 15,700 >20X |
| Metal | Tungsten | 18,820 ~30X |

What is claimed is:

1. A stringed musical instrument comprising a body section, a head secured to said body by a neck region, said head having means for securing the distal ends of a plurality of strings to said musical instrument, a bridge to support the proximal ends of said strings above said body section, anchoring means for securing said proximal ends of said strings to said musical instrument, a soundboard secured to said body section, said soundboard being a layer of granite having a thickness in the range from about an eighth to about eleven sixteenths of an inch, a bridge member and a bridge-contacting block, said bridge member being secured to said bridge-contacting block, said bridge contacting-block being a high acoustic transfer material having a specific gravity of at least two, and being in acoustic contact with said soundboard.

2. A stringed musical instrument comprising in combination;

a body section;

said body section being a solid piece of wood having at least one recess and at least one block of a high vibratic transfer, high density material having a density at least equal to the density of granite, said at least one block being within said at least one recess, and said block being in acoustic contact with said soundboard;

a head secured to said body by a neck region, said head having means for securing said distal ends of a plurality of strings to said musical instrument;

a bridge supporting the proximal ends of said strings an anchoring means, said proximal ends of said strings being secured by said anchoring means to said musical instrument;

a soundboard secured to said body section;

said soundboard being a layer of a high density solid mineral; and an electric pickup in acoustical contact with, and supported by, said at least one block.

3. The stringed musical instrument of claim 2, further comprising at least a second electric pickup and at least a second block, said solid wood having a second recess, said at least a second block being a high acoustic transfer material having a specific gravity of at least two, and being within said second recess, and being in acoustic contact with said soundboard and said second electric pickup.

4. The stringed musical instrument of claim 1, wherein said body section is a solid piece of wood having at least one recess, a first block, said at least one high acoustic transfer material having a specific gravity of at least two, and being within said at least one recess, and said first block being in acoustic contact with said soundboard.

5. The stringed musical instrument of claim 2, further comprising a transfer rod, said transfer rod being a high acoustic transfer material having a specific gravity of at least 2, and being in acoustic contact with said soundboard and said at least one block.

6. The stringed musical instrument of claim 5, further comprising a second high vibratic transfer block, said second transfer block being a high acoustic transfer material having a specific gravity of at least two, said second block being in acoustic contact with the base of said neck region and said transfer rod.

7. A stringed musical instrument comprising a body section, a head secured to said body by a neck region, said head having means for securing the distal ends of a plurality of strings to said musical instrument, a bridge to support the proximal ends of said strings and anchoring means for securing said proximal ends of said strings to said musical instrument, and a soundboard secured to said body section, said body section being a hollow bodied member, at least a first high vibratic transfer block, said block being in acoustic contact with said soundboard and at least one member selected from the group comprising a bridge, an anchoring means, the base of said neck region, and at least one acoustic pickup, wherein said block has a specific gravity of at least two.

8. The stringed musical instrument of claim 7, further comprising an electric pickup supported by, and in acoustic contact with, said at least one block.

9. The stringed musical instrument of claim 7, further comprising at least a second high vibratic transfer block, said second block being a high acoustic transfer material having a specific gravity of at least two, and being in acoustic contact with said soundboard.

10. The stringed musical instrument of claim 9, further comprising a bridge contacting high vibratic transfer block and bridge secured to said bridge contacting high vibratic transfer block, said bridge contacting being in acoustic contact with said soundboard, said soundboard being a layer of a mineral having a specific gravity of at least two, and having a thickness in the range from about ⅛ to 11/16 of an inch.

11. The stringed musical instrument of claim 1, wherein said musical instrument is selected from the group comprising an acoustic guitar, an electric guitar, an acoustic bass, an electric bass, a cello, a viola, and a harp.

12. The stringed musical instrument of claim 11, further comprising an electric pickup supported by a first granite block, said first granite block being in acoustic contact with said soundboard, a bridge contacting granite block and a bridge secured to said bridge contacting granite block, said bridge contacting granite block being in acoustic contact with said soundboard, said soundboard having a thickness in the range from about two to about four sixteenths of an inch, and a granite transfer rod, said granite transfer rod being in acoustic contact with said soundboard, and said first granite block.

13. The stringed musical instrument of claim 1, wherein said block is selected from the group comprising granite, high acoustic transmitting ceramic and high acoustic transmitting metal.

14. The stringed musical instrument of claim 2, wherein said block is selected from the group comprising granite, high acoustic transmitting ceramic and high acoustic transmitting metal.

15. The stringed musical instrument of claim 7, wherein said block is selected from the group comprising granite, high acoustic transmitting ceramic and high acoustic transmitting metal.

16. The method of producing vibratical unification of components of a musical instrument comprised of a soundboard, a plurality of strings, a bridge system, a neck and a body, comprising the steps of;

acoustically interconnecting each of said components in a time-correct sound transfer loop, said sound loop comprising a soundboard, a plurality of strings, a bridge system, a neck, a body, a high sound acoustically conductive material and a pick up acoustically coupled to a high sound acoustically conductive material having a specific gravity of at least two.

17. The method of claim 16, wherein said acoustically high sound conductivity material is selected from the group comprising minerals, ceramics, metals, and combinations thereof, thereby producing a balanced, compressed, and naturally equalized sound, with extreme clarity and sustain, and with minimal distortion.

18. The method of claim 17, wherein said acoustically high sound conductivity material has a specific gravity on the order of at least 2.6.

19. The method of claim 17, wherein said acoustically high sound conductivity material has a specific gravity on the order of at least four.

* * * * *